US008275296B2

(12) United States Patent
Fujikura

(10) Patent No.: US 8,275,296 B2
(45) Date of Patent: Sep. 25, 2012

(54) IMAGE FORMING APPARATUS

(75) Inventor: Shuichi Fujikura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 442 days.

(21) Appl. No.: 12/561,385

(22) Filed: Sep. 17, 2009

(65) Prior Publication Data

US 2010/0080588 A1 Apr. 1, 2010

(30) Foreign Application Priority Data

Sep. 30, 2008 (JP) ..... 2008-254080

(51) Int. Cl.
*G03G 15/09* (2006.01)

(52) U.S. Cl. ..... 399/270; 399/44; 399/66

(58) Field of Classification Search ..... 399/44, 399/50, 66, 231, 235, 240, 270, 314
See application file for complete search history.

(56) References Cited

U.S. PATENT DOCUMENTS

2004/0202488 A1* 10/2004 Mashiba et al. ..... 399/66

FOREIGN PATENT DOCUMENTS

JP 11-024368 A 1/1999
JP 2006-078544 A 3/2006

* cited by examiner

*Primary Examiner* — Walter L Lindsay, Jr.
*Assistant Examiner* — Barnabas Fekete
(74) *Attorney, Agent, or Firm* — Kubotera & Associates, LLC

(57) ABSTRACT

An image forming apparatus includes first and second image supporting members; first and second developer supporting members for forming a first developer image in a first color and a second developer image in a second color, respectively; first and second transfer members for transferring the first developer image and the second developer image to a medium, respectively; a voltage applying unit for applying a first voltage to one of the first image supporting member and the first transfer member and a second voltage to one of the second image supporting member and the second transfer member. The voltage applying unit is arranged to apply the second voltage greater than the first voltage to one of the second image supporting member and the second transfer member when a printing operation is performed to form an image only in the first color.

10 Claims, 9 Drawing Sheets

| | Environmental condition | Transfer voltage [V] | | | |
|---|---|---|---|---|---|
| | | Black | Yellow | Magenta | Cyan |
| Color printing operation | Low temperature/ Low humidity | 4920 | 4926 | 4933 | 4736 |
| | Normal temperature/ Normal humidity | 3668 | 3851 | 4037 | 4220 |
| | High temperature/ High humidity | 2924 | 3194 | 3370 | 3610 |
| Single color printing operation | Low temperature/ Low humidity | 4920 | 5000 | 5000 | 5000 |
| | Normal temperature/ Normal humidity | 3668 | 4236 | 4441 | 4642 |
| | High temperature/ High humidity | 2924 | 3609 | 3707 | 3971 |

| | Environmental condition | Transfer voltage [V] | | | |
|---|---|---|---|---|---|
| | | Black | Yellow | Magenta | Cyan |
| Color printing operation | Low temperature/ Low humidity | 4920 | 4926 | 4933 | 4736 |
| | Normal temperature/ Normal humidity | 3668 | 3851 | 4037 | 4220 |
| | High temperature/ High humidity | 2924 | 3194 | 3370 | 3610 |
| Single color printing operation | Low temperature/ Low humidity | 4920 | 5000 | 5000 | 5000 |
| | Normal temperature/ Normal humidity | 3668 | 4236 | 4441 | 4642 |
| | High temperature/ High humidity | 2924 | 3609 | 3707 | 3971 |

FIG. 6

IMAGE FORMING APPARATUS

BACKGROUND OF THE INVENTION AND RELATED ART STATEMENT

The present invention relates to an image forming apparatus.

A conventional image forming apparatus such as a printer, a copier, a facsimile, a multi-function product, and the likes is provided with image forming units in colors such as black, yellow, magenta, and cyan. Accordingly, it is possible to switch between a color printing operation and a printing operation in one specific color, for example, a monochrome printing operation.

When the conventional image forming apparatus performs the color printing operation, a sheet contacts with a photosensitive drum as an image supporting member disposed in each of the image forming units. When the conventional image forming apparatus performs the monochrome printing operation, a sheet contacts with a photosensitive drum as an image supporting member disposed in the image forming unit of black. At this time, it is arranged such that the image forming units of the other colors move upwardly with a cam and the likes, so that the sheet does not contact with photosensitive drums of the image forming units of the other colors. Accordingly, it is possible to prevent the image forming units of the other colors from operating, thereby reducing wear or deterioration of the photosensitive drums thereof (refer to Patent Reference).

Patent Reference: Japan Patent Publication No. 2006-78544

In the conventional image forming apparatus described above, when the color printing operation is switched to the monochrome printing operation, it is necessary to move the image forming units of the other colors from a medium transportation path while the image forming unit of one color remains on the medium transportation path. When the monochrome printing operation is switched to the color printing operation, it is necessary to place the image forming units of the other colors on the medium transportation path, thereby taking a relatively long period of time.

When it is necessary to perform both the monochrome printing operation and the color printing operation, it may be arranged such that the image forming units of the other colors do not move from the medium transportation path, i.e., the state in the color printing operation.

In each of the image forming units, a developing blade as a developer regulating member is disposed to abut against a developing roller. The developing blade charges toner as developer through friction therebetween, so that toner is attached to a static latent image formed on the photosensitive drum, thereby forming a toner image as a developer image.

Occasionally, when the developing blade charges toner, a small amount of toner tends to be charged with an opposite polarity. In this case, a small amount of toner charged with an opposite polarity, or opposite charged toner, does not spontaneously adhere to a sheet due to a potential balance. However, when the opposite charged toner physically contacts with the sheet, the opposite charged toner may adhere to the sheet through van der Waals attraction.

When a small amount of toner adheres to the sheet in the printing operation, toner may cover a background of the sheet, i.e., a phenomenon called a fog, thereby deteriorating image quality.

In view of the problems described above, an object of the present invention is to provide an image forming apparatus capable of solving the problems of the conventional image forming apparatus. In the image forming apparatus of the present invention, it is possible to perform a printing operation without causing a fog, thereby improving image quality.

Further objects of the invention will be apparent from the following description of the invention.

SUMMARY OF THE INVENTION

In order to attain the objects described above, according to an aspect of the present invention, an image forming apparatus includes a first image supporting member for forming a first static latent image thereon; a second image supporting member for forming a second static latent image thereon; a first developer supporting member disposed to abut against the first image supporting member for attaching developer to the first static latent image to form a first developer image in a first color; a second developer supporting member disposed to abut against the second image supporting member for attaching developer to the second static latent image to form a second developer image in a second color; a first transfer member disposed to abut against the first image supporting member for transferring the first developer image on the first image supporting member to a medium; a second transfer member disposed to abut against the second image supporting member for transferring the second developer image on the second image supporting member to the medium; and a voltage applying unit for applying a first voltage to one of the first image supporting member and the first transfer member and a second voltage to one of the second image supporting member and the second transfer member.

According to the aspect of the present invention, the voltage applying unit applies the first voltage to one of the first image supporting member and the first transfer member when a printing operation is performed to form an image only in the first color. The voltage applying unit applies the second voltage to one of the second image supporting member and the second transfer member so that the second voltage is greater than the first voltage when the printing operation is performed to form the image only in the first color.

In the aspect of the present invention, the image forming apparatus includes the first image supporting member for forming the first static latent image thereon; the second image supporting member for forming the second static latent image thereon; the first developer supporting member disposed to abut against the first image supporting member for attaching developer to the first static latent image to form the first developer image in the first color; the second developer supporting member disposed to abut against the second image supporting member for attaching developer to the second static latent image to form the second developer image in the second color; the first transfer member disposed to abut against the first image supporting member for transferring the first developer image on the first image supporting member to the medium; the second transfer member disposed to abut against the second image supporting member for transferring the second developer image on the second image supporting member to the medium; and the voltage applying unit for applying the first voltage to one of the first image supporting member and the first transfer member and the second voltage to one of the second image supporting member and the second transfer member.

In the aspect of the present invention, the voltage applying unit applies the first voltage to one of the first image supporting member and the first transfer member when a printing operation is performed to form the image only in the first color. The voltage applying unit applies the second voltage to one of the second image supporting member and the second transfer member so that the second voltage is greater than the first voltage when the printing operation is performed to form the image only in the first color.

When the image forming apparatus performs the printing operation for forming an image only in a single color, the voltage applying unit applies the first voltage to one of the first image supporting member and the first transfer member, and the second voltage to one of the second image supporting member and the second transfer member, so that the second voltage is greater than the first voltage. Accordingly, it is possible to prevent a fog, thereby improving image quality.

BRIEF DESCRIPTION OF THE DRAWINGS

FIG. 6 is a table showing transfer voltages of the color printer according to the first embodiment of the present invention;

DETAILED DESCRIPTION OF THE PREFERRED EMBODIMENTS

Hereunder, embodiments of the present invention will be described in detail with reference to the accompanying drawings. In the specification, a color printer will be explained as an image forming apparatus.

First Embodiment

Figure 2:
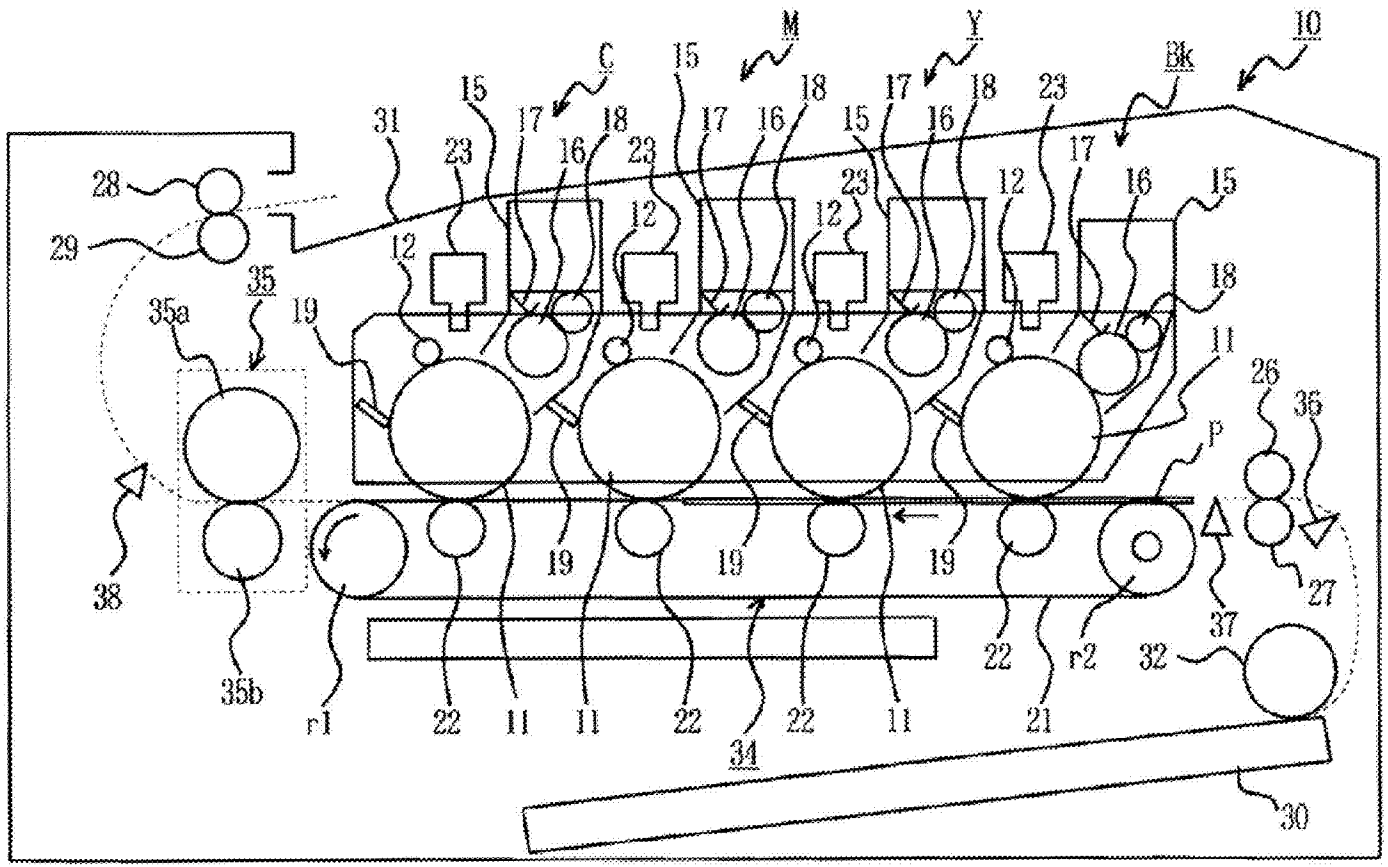
FIG. 2 is a schematic sectional view showing the color printer according to the first embodiment of the present invention.

A first embodiment of the present invention will be explained. FIG. 2 is a schematic sectional view showing a color printer according to the first embodiment of the present invention.

As shown in FIG. 2, the color printer includes a main body of the color printer or an apparatus main body 10. A transportation path with an S character shape is disposed in the apparatus main body 10 for transporting a sheet P as a medium. Along the transportation path, there are arranged transportation rollers 26 and 27; image forming units Bk, Y, M, and C for forming toner images as developer images in colors such as black, yellow, magenta, and cyan; and discharge rollers 28 and 29. A transfer unit 34 as a belt drive unit is disposed below the image forming units Bk, Y, M, and C for transporting the sheet P and transferring the toner images to the sheet P to form a color toner image. Each of the image forming units Bk, Y, M, and C includes a photosensitive drum 11 as an image supporting member.

In the embodiment, an LED (Light Emitting Diode) head 23 is disposed in the apparatus main body 10 to face the photosensitive drum 11 of each of the image forming units Bk, Y, M, and C. A fixing device 35 as a fixing unit is disposed on a downstream side of the transfer unit 34 in a direction that the sheet P is transported for fixing the color toner image to the sheet P. The fixing device 35 includes a fixing roller 35*a* and a backup roller 35*b*.

In the embodiment, a charge roller 12 as a charging device is disposed in each of the image forming units Bk, Y, M, and C to contact with the photosensitive drum 11 with a specific pressure. The charge roller 12 rotates in a direction opposite to a rotational direction of the photosensitive drum 11, and uniformly charges a surface of the photosensitive drum 11. The photosensitive drum 11 rotates at a specific rotational speed, and is capable of accumulating electric charges on the surface thereof. When the LED head 23 exposes the photosensitive drum 11 to remove charges on the surface thereof, the static latent image as a static image is formed on the photosensitive drum 11.

In the embodiment, a developing roller 16 as a developer supporting member is disposed in each of the image forming units Bk, Y, M, and C adjacent to the photosensitive drum 11 for attaching toner as developer to the photosensitive drum 11, thereby developing the static latent image to form the toner image. A developing blade 17 as a developer regulating member is disposed in each of the image forming units Bk, Y, M, and C for regulating a thickness of toner on the developing roller 16. A toner supply roller 18 as a developer supplying member is disposed in each of the image forming units Bk, Y, M, and C for supplying toner to the developing roller 16.

In the embodiment, the developing roller 16 is pressed against the photosensitive drum 11 with a specific pressure, and rotates in a direction opposite to the rotational direction of the photosensitive drum 11. Further, the toner supply roller 18 is pressed against the developing roller 16 with a specific pressure, and rotates in a direction the same as that of the developing roller 16.

In the embodiment, a cleaning blade 19 as a cleaning member formed of an elastic member is disposed in each of the image forming units Bk, Y, M, and C to contact with the photosensitive drum 11. The cleaning blade 19 scrapes off and removes toner remaining on the photosensitive drum 11. Note that the developing roller 16, the developing blade 17, and the toner supply roller 18 constitute a developing device.

In the embodiment, the photosensitive drum 11, the charge roller 12, the developing roller 16, the developing blade 17, the toner supply roller 18, the cleaning blade 19, and the likes constitute a main body of each of the image forming units Bk, Y, M, and C, or an image forming unit main body. A toner cartridge 15 as a developer container or a developer cartridge is detachably attached to the image forming unit main body for retaining toner.

In the embodiment, the transfer unit 34 includes a drive roller r1 as a first roller; an idle roller r2 as a second roller; a transfer belt 21 extended with the drive roller r1 and the idle roller r2 to be freely movable; and transfer rollers 22 disposed to face the photosensitive drums 11 with the transfer belt 21 in between. The transfer belt 21 and the transfer rollers 22 transfer the toner images on the photosensitive drums 11 to the sheet P.

In the embodiment, a sheet cassette 30 as a medium retaining portion is disposed below the transfer unit 34 at an end portion of the transportation path for retaining the sheet P. A pickup roller 32 is disposed on the sheet cassette 30 for picking up the sheet P. Further, along the transportation path, there are provided an inlet sensor 36 for detecting that the sheet P is picked up; a writing sensor 37 for detecting a leading edge of the sheet P to determine a writing timing; and a discharge sensor 38 for monitoring whether the leading edge of the sheet P passes through the fixing device 35. A stacker 31 is disposed at an upper portion of the apparatus main body 10 for placing the sheet P after a color image is formed on the sheet P and the sheet P is discharged.

An operation of the color printer will be explained next. First, in each of the image forming units Bk, Y, M, and C, the charge roller 12 uniformly charges the surface of the photosensitive drum 11, and the LED head 23 exposes the surface of the photosensitive drum 11, thereby forming the static latent image thereon. Then, the developing device develops the static latent image to form the toner image in each color.

After the pickup roller 32 picks up the sheet P, the transportation rollers 26 and 27 transport the sheet P, so that the sheet P is attached to the transfer belt 21 through a static force. When the transfer belt 21 moves, the sheet P is transported between the image forming units Bk, Y, M, and C and the transfer unit 34. When the sheet P passes through between the image forming units Bk, Y, M, and C and the transfer unit 34, the toner images in colors are transferred and overlapped on the sheet P, thereby forming the color toner image. When the sheet P passes through the fixing device 35, the color toner image is fixed to the sheet P, thereby forming the color image. Afterward, the discharge rollers discharge the sheet P to the stacker 31.

Figure 1:
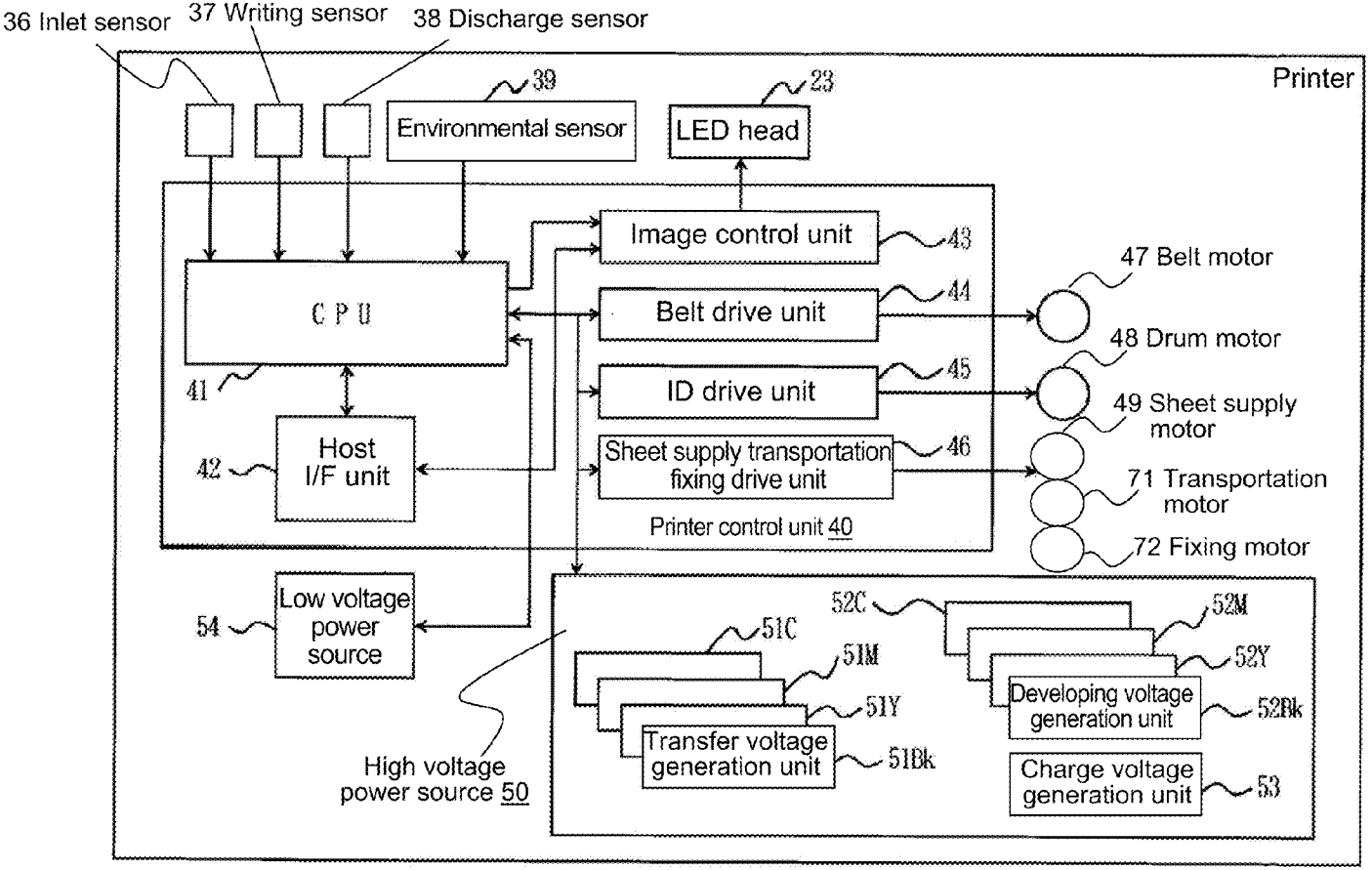
FIG. 1 is a block diagram showing a control system of a color printer according to a first embodiment of the present invention.

FIG. 1 is a block diagram showing a control system of the color printer according to the first embodiment of the present invention. As shown in FIG. 1, the control system of the color printer includes a printer control unit 40.

In the embodiment, the printer control unit 40 includes a CPU (Central Processing Unit) 41 operating with a program stored in an ROM (not shown); a host I/F unit 42 for connecting to a host computer (not shown) through a wired network or a wireless network; an image control unit 43; a belt drive unit 44; an ID drive unit 45; and a sheet supply transportation fixing drive unit 46.

In the embodiment, the image control unit 43 deploys fonts and generates tones according to data transmitted from the host computer, i.e., print data, and sends image data to the LED heads 23. The belt drive unit 44 sends a phase signal for driving a belt motor 47 as a first drive unit to move the transfer belt 21, and generates a current value reference. The ID drive unit 46 controls a drum motor 48 as a second drive unit to rotate the photosensitive drum 11 in each of the image forming units Bk, Y, M, and C.

In the embodiment, the sheet supply transportation fixing drive unit 46 controls a sheet supply motor 49 as a third drive unit to rotate the pickup roller 32; controls a transportation motor 71 as a fourth drive unit to rotate the transportation rollers 26 and 27 and the discharge rollers 28 and 29; and controls a fixing motor 72 as a fifth drive unit to rotate the fixing roller 35*a* and the backup roller 35*b*. The transportation motor 71 also rotates rollers (not shown) disposed along the transportation path with an interval smaller than a minimum medium distance or operates a medium path switching solenoid (not shown) for switching the transportation path.

In the embodiment, the CPU 41 is connected to various sensors such as the inlet sensor 36, the writing sensor 37, the discharge sensor 38, and an environmental sensor 39, so that the CPU 41 retrieves sensor outputs from the sensors. The environmental sensor 39 includes a thermistor (not shown) for detecting a temperature as a first printing environmental parameter and a polymer type humidity sensor (not shown) for detecting humidity as a second printing environmental parameter.

In the embodiment, a high voltage power source 50 includes transfer voltage generation units 51Bk, 51Y, 51M, and 51C for applying a transfer voltage as a high voltage to the transfer rollers 22; developing voltage generation units 52Bk, 52Y, 52M, and 52C for applying a developing voltage (a developing bias) as a high voltage to the developing rollers 16; and a charge voltage generation unit 53 for applying a charge voltage as a high voltage to the charge rollers 12. Further, the high voltage power source 50 includes a transformer (not shown) and an amplifier (not shown) for adjusting and applying the developing voltage, the transfer voltage, and the charge voltage.

In the embodiment, the charge rollers 12, the developing rollers 16, and the transfer rollers 22 constitute voltage applied members to which the developing voltage, the transfer voltage, and the charge voltage are applied.

In the embodiment, a low voltage power source 54 applies a voltage of 5 V to the various sensors such as the inlet sensor 36, the writing sensor 37, the discharge sensor 38, and the environmental sensor 39, and applies a voltage of 24 V to various circuits of the printer control unit 40.

An operation of the control system of the color printer will be explained next. First, when the host I/F unit 42 receives the print data transmitted from the host computer, and further receives an instruction of a printing operation through the print data, the host I/F unit 42 rotates the pickup roller 32 to pick up the sheet P from the sheet cassette 30 one by one, thereby supplying the sheet P to the transportation rollers 26 and 27. The inlet sensor 36 detects whether the pickup roller 32 normally picks up the sheet P.

At substantially the same time when the pickup roller 32 starts supplying the sheet P, the rollers in the image forming units Bk, Y, M, and C start rotating. Further, the belt motor 47 is driven to move the transfer belt 21. At the same time when the rollers start rotating, the high voltage power source 50 applies the charge voltage of −1,000 V to the charge rollers 12, and applies the developing voltage of 400 V to the developing rollers 16.

In the next step, the transportation rollers 26 and 27 transport the sheet P further. When the sheet P reaches the writing sensor 37, the writing sensor 37 is turned on. After the writing sensor 37 is turned on, when a specific period of time is elapsed, the LED heads 23 start exposing to form the static latent images on the photosensitive drums 11. Then, the developing rollers 16 attach toner to the static latent images, so that the toner images are formed on the photosensitive drums 11.

In the next step, when the sheet P reaches between the photosensitive drum 11 and the transfer roller 22 in each of the image forming units Bk, Y, M, and C, the high voltage power source 50 applies the transfer voltage of +2,000 to 5,000 V to the transfer roller 22, thereby transferring the toner image to the sheet. In the embodiment, when a color printing operation is performed, the high voltage power source 50 applies the transfer voltage different from that in a single color printing operation, for example, a monochrome printing operation. The transfer voltage is adjusted according to the temperature and humidity detected with the environmental sensor 39.

After the toner images are transferred to the sheet P, the sheet P is heated and pressed between the fixing roller 35*a* and the backup roller 35*b*, so that the toner images are fixed to the sheet P. After the toner images are fixed to the sheet P, the discharge rollers 28 and 29 discharge the sheet P to the stacker 31.

In the embodiment, among the image forming units Bk, Y, M, and C, the developing devices of the image forming units Y, M, and C constitute a developing unit. The developing unit is arranged to be movable between an operational position as a first position where the photosensitive drums 11 contact with the developing rollers 16 and a retreated position as a second position where the photosensitive drums 11 are away from the developing rollers 16. Accordingly, it is possible to switch between the color printing operation and the monochrome printing operation.

In the embodiment, when the developing unit is situated at the operational position, the developing unit forms an image. When the developing unit is situated at the retreated position, the developing unit does not form an image. That is, the developing unit as a position switching unit switches a position thereof between the operational position and the retreated position. Alternatively, it may be arranged such that the image forming units Y, M, and C constitute a position switching unit.

Figure 3:
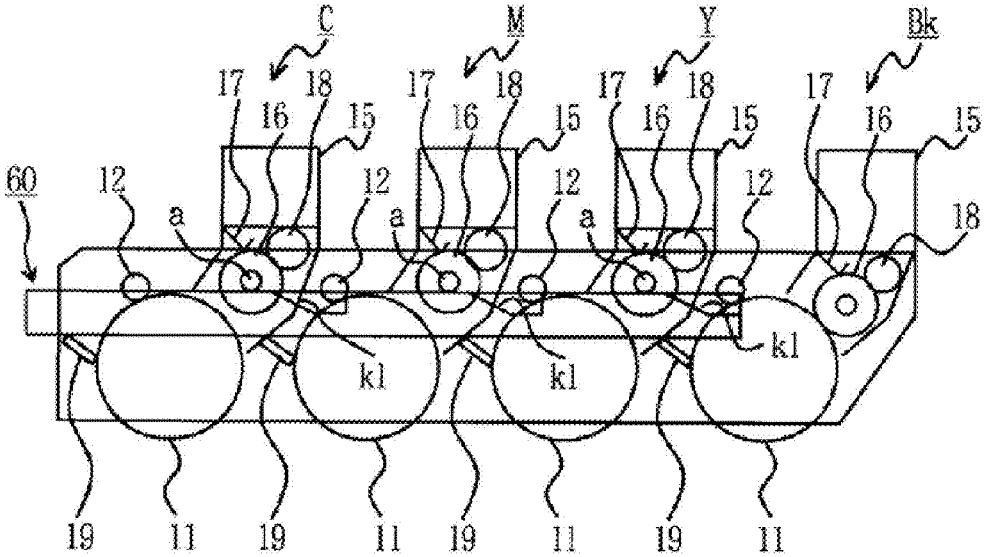
FIG. 3 is a schematic sectional view showing the color printer in a state that a developing unit is situated at a retreated position according to the first embodiment of the present invention.
Figure 4:
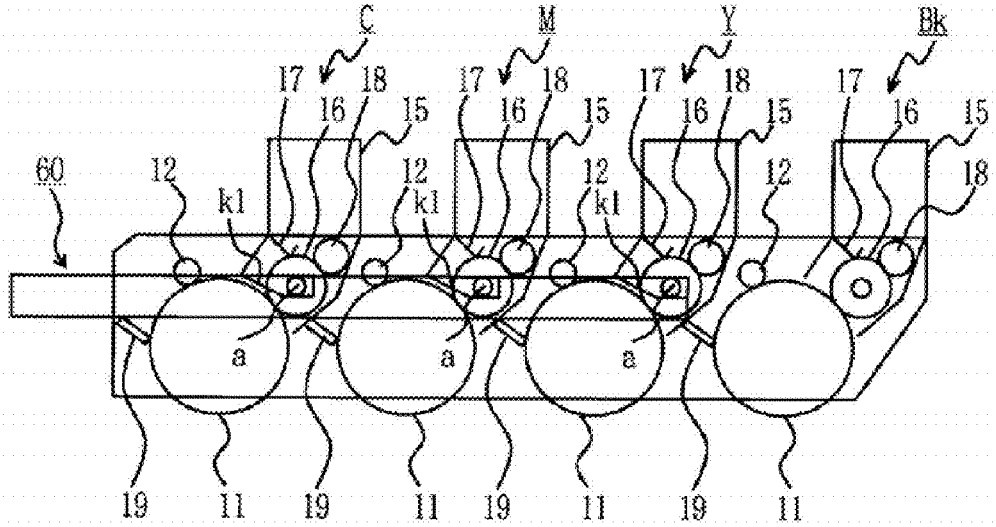
FIG. 4 is a schematic sectional view showing the color printer in a state that the developing unit is situated at an operational position according to the first embodiment of the present invention.

FIG. 3 is a schematic sectional view showing the color printer in a state that the developing unit is situated at the retreated position according to the first embodiment of the present invention. FIG. 4 is a schematic sectional view showing the color printer in a state that the developing unit is situated at the operational position according to the first embodiment of the present invention.

As shown in FIGS. 3 and 4, the color printer includes a link lever 60 extending horizontally along the image forming units Y, M, and C. The link lever 60 is arranged to movable as a link member for connecting the developing devices of the image forming units Y, M, and C. The link lever 60 includes recess portions k1 functioning as a cam at positions corresponding to the developing rollers 16. The recess portion k1 has a bottom portion and an inclined portion extending from the bottom portion in an inclined state.

As shown in FIG. 3, when the link lever 60 is situated at an advanced position as a first position, an engaging portion of each of the developing rollers 16, i.e., a shaft a, is disengaged from the recess portion k1 and moves upward, thereby placing the developing unit at the retreated position. When the developing unit is situated at the retreated position, only the developing roller 16 of the image forming unit Bk contacts with the photosensitive drum 11. Accordingly, it is possible to perform the monochrome printing operation using black toner.

In the embodiment, a motor (not shown) is provided as a vertical movement drive unit, and a gear row (not shown) is provided for decelerating a rotation of the motor. When the motor is driven, a rack-and-pinion (not shown) as a movement direction conversion unit converts a rotational movement of the motor to a linear movement for moving the link lever 60.

In the embodiment, a continuous printing operation may be performed for printing on a plurality of sheets P. In the continuous printing operation, when the developing unit moves to the retreated position while the sheet P is situated on the transfer belt 21, the sheet P may be transported at a fluctuated speed due to a variance in a load applied to the transfer belt 21, thereby causing a streak in an image and deteriorating image quality.

To this end, it is necessary to transport the sheet P with an interval greater than a length of the transfer belt 21, or to perform the continuous printing operation while the developing unit is situated at the operational position. In general, when the sheet P is transported with an interval greater than the length of the transfer belt 21, the rollers of the image forming units Y, M, and C rotate idly, thereby shortening a life of the image forming units Y, M, and C. Further, it is necessary to take a long period of time to complete the continuous printing operation, thereby lowering print through put.

To this end, in the embodiment, when the continuous printing operation is performed for printing on a plurality of sheets P, the monochrome printing operation is performed while the developing unit of each of the image forming units Y, M, and C stays at the operational position.

In each of the image forming units Bk, Y, M, and C, the developing blade 17 disposed to abut against the developing roller 16 charges toner with a specific polarity at a constant potential, so that toner adheres to the static latent image formed on the photosensitive drum 11, thereby forming the toner image. Occasionally, when the developing blade 17 charges toner, a small amount of toner tends to be charged with an opposite polarity.

In this case, when the monochrome printing operation is performed while the developing units of the image forming units Y, M, and C stay at the operational position, a small amount of toner charged with an opposite polarity, or opposite charged toner, does not spontaneously adhere to a sheet due to a potential balance. However, when the opposite charged toner physically contacts with the sheet P, the opposite charged toner may adhere to the sheet P through van der Waals attraction, thereby causing a fog and lowering image quality.

In this case, the opposite charged toner has a polarity the same as that of the transfer voltage. Accordingly, in theory, it is possible to remove the opposite charged toner from the sheet P through applying the transfer voltage to the transfer roller 22. In an actual case, however, even when the transfer voltage is applied to the opposite charged toner adhering to the sheet P in a state that the transfer voltage is applied at an upstream side in a transportation direction of the sheet P, it is difficult to remove the opposite charged toner from the sheet P.

Accordingly, when the transfer voltage having a grater absolute value is applied to the transfer roller 22 at a downstream side in the transportation direction of the sheet P, it is possible to move the opposite charged toner adhering to the sheet P to the photosensitive drum 11, thereby preventing the fog.

Further, when toner of the toner image transferred at the upstream side contacts with the photosensitive drum 11 on the downstream side, toner tends to adhere to the photosensitive drum 11 on the downstream side, i.e., a phenomenon called a reverse transfer. In this case, toner adhering to the photosensitive drum 11 on the downstream side has a normal amount of charges. Accordingly, when the transfer voltage having a grater absolute value is applied to the transfer roller 22 at the downstream side, it is possible to prevent the reverse transfer.

When the transfer voltage having an excessively high absolute value is applied to the transfer roller 22 at the downstream side, toner of the toner image tends to come off from the photosensitive drum 11 and adhere to the sheet P at a timing earlier than a normal transfer timing, thereby distorting an image and lowering image quality. Accordingly, when the toner image is transferred to the sheet P, it is necessary to adjust the transfer voltage at a level so that the image is not distorted.

To this end, in the embodiment, when the monochrome printing operation is performed while the developing unit is situated at the operational position, the transfer voltage applied to the transfer rollers 22 of the image forming units Y, M, and C, i.e., the colors whose toner images are not formed, has the absolute value greater than that of the transfer voltage applied to the transfer roller 22 of the image forming unit Bk, i.e., the color whose toner image is formed.

More specifically, the transfer voltage applied to the transfer rollers 22 of the image forming units Y, M, and C has the absolute value greater than that of the transfer voltage applied to the transfer roller 22 of the image forming unit Bk by 100 V to 1,000 V. Accordingly, it is possible to move the opposite charged toner from the sheet P to the photosensitive drums 11, thereby preventing the reverse transfer.

Figure 5:
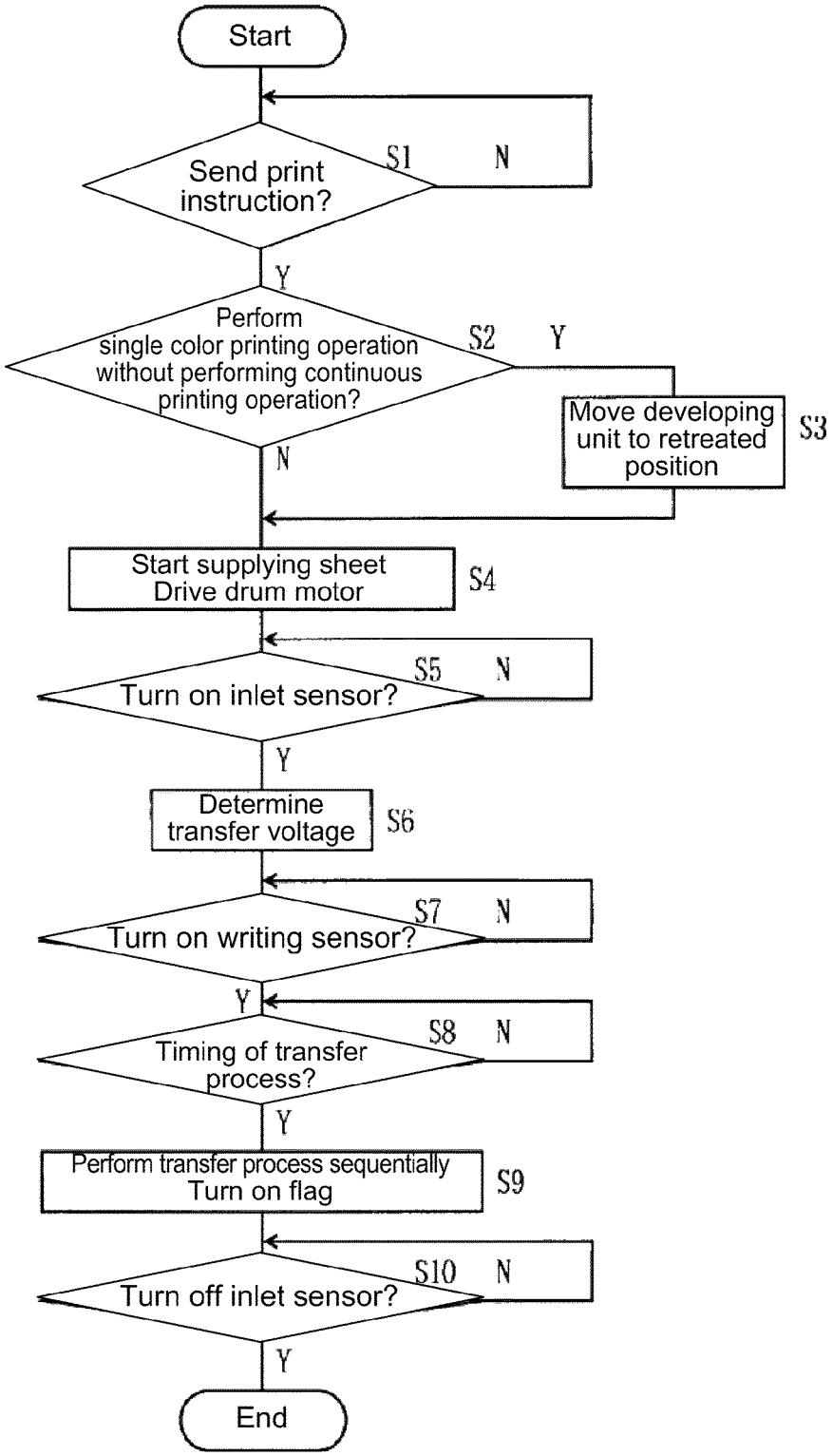
FIG. 5 is a flow chart showing an operation of the color printer according to the first embodiment of the present invention.

An operation of the color printer will be explained next. FIG. 5 is a flow chart showing the operation of the color printer according to the first embodiment of the present invention. FIG. 6 is a table showing the transfer voltages of the color printer according to the first embodiment of the present invention. In the embodiment, although a jam monitoring process or a sensor operation process is performed in an actual operation, explanations thereof are omitted.

First, the CPU 41 waits for the print instruction from the host computer. In this state, the fixing device 35 is maintained at a specific temperature, so that it is possible to immediately start the printing operation once the print instruction is transmitted. Note that the fixing device 35 is maintained at the specific temperature lower than a normal fixing temperature at which the printing operation is actually performed. When the printing operation starts, the fixing device 35 is heated up to the normal fixing temperature at a timing that the sheet P reaches the fixing device 35.

In the next step, when the host computer transmits the print instruction, a print instruction determination processing unit (not shown) of the CPU 41 performs a print instruction determination process to determine whether the print instruction instructs the single color printing operation without performing the continuous printing operation. When it is determined that the print instruction instructs the single color printing operation without performing the continuous printing operation, it is possible to move the developing rollers 16 away from the photosensitive drums 11. Accordingly, a separation processing unit (not shown) of the CPU 41 performs a separation process to move the developing units to the retreated position, thereby moving the developing rollers 16 away from the photosensitive drums 11.

When it is determined that the print instruction instructs the continuous printing operation or the printing operation (the color printing operation) other than the single color printing operation, the developing units stay at the operational position. Note that when the continuous printing operation is performed, the single color printing operation is performed while the developing units stay at the operational position.

In the next step, the sheet supply transportation fixing drive unit 46 drives the sheet supply motor 49 to start supplying the sheet P. Further, the ID drive unit 45 drives the drum motor 48 to start rotating the photosensitive drums 11 and the likes, and the belt drive unit 44 drives the belt motor 47 to start moving the transfer belt 21. Note that the belt motor 47, the drum motor 48, and the sheet supply motor 49 are driven at this timing, so that the photosensitive drums 11 rotate more than one rotation before the sheet P reaches the photosensitive drums 11, thereby stabilizing the surfaces of the photosensitive drums 11.

When the sheet P reaches the inlet sensor 36 to turn on the inlet sensor 36, a transfer voltage determination processing unit (not shown) of the CPU 41 performs a transfer voltage determination process for retrieving a temperature and humidity from the environmental sensor 39, so that the transfer voltage is determined with reference to the table shown in FIG. 6. Note that the table is stored in a storage unit (not shown) disposed in the printer control unit 40.

In the table, the transfer voltage is defined per each color under environmental conditions such as low temperature/low humidity, normal temperature/normal humidity, and high temperature/high humidity in the color printing operation and the single color printing operation.

As shown in FIG. 6, when the color printing operation is performed, the transfer voltage is set higher than that in the single color printing operation by a range of 100 to 1,000 V. Note that the high voltage power source 50 has an upper limit of an output at 5,000 V. Accordingly, even when the transfer voltage is greater than 5,000 V, the high voltage power source 50 does not output a voltage greater than 5,000 V.

When the sheet P reaches the writing sensor 37 to turn on the writing sensor 37, the image control unit 43 starts transmitting the image data to the LED heads 23 at a specific timing after a specific period of time, so that the LED heads 23 are driven and form the static latent images on the surfaces of the photosensitive drums 11. When the color printing operation is performed, the image control unit 43 transmits the image data to all of the LED heads 23. When the single color printing operation is performed, the image control unit 43 transmits the image data only to the LED head 23 of the image forming unit Bk.

In the next step, a transfer processing unit (not shown) of the CPU 41 performs a transfer process as a voltage application process at a specific transfer timing after a specific period of time after the writing sensor 37 is turned on. In the transfer process, with reference to the table shown in FIG. 6, the transfer voltage generation units 51Bk, 51Y, 51M, and 51C generate transfer voltages VBk, VY, VM, and VC for black, yellow, magenta, and cyan. Then, the transfer voltages VBk, VY, VM, and VC are sequentially applied to the transfer rollers 22 with a specific interval.

In the transfer process, when the color printing operation is performed, the toner image in black, the toner image in yellow, the toner image in magenta, and the toner image in cyan are transferred to the sheet P. When the single color printing operation is performed, only the toner image in black is transferred.

In the embodiment, the transfer processing unit (not shown) is arranged to turn on a flag during the transfer process, so that the flag can be referred during other processing routines.

When a trailing edge of the sheet P is detected and the inlet sensor 36 is turned off, a series of the processes from the sheet supply process to the transfer process is complete, so that the flag is turned off. Afterward, the color toner image is fixed to the sheet P, and the sheet P is discharged to the stacker 31. After the sheet P is discharged, a series of the processes is repeated for printing a next sheet.

The flow chart shown in FIG. 5 will be explained next. In step S1, the CPU 41 waits for the print instruction from the host computer. When the host computer sends the print instruction, the process proceeds to step S2. In step S2, it is determined whether the single color printing operation is performed without performing the continuous printing operation. When it is determined that the single color printing operation is performed without performing the continuous printing operation, the process proceeds to step S3. When it is determined that the single color printing operation is not performed or the continuous printing operation is performed, the process proceeds to step S4.

In step S3, the developing unit moves to the retreated position. In step S4, the sheet supply transportation fixing drive unit 46 drives the sheet supply motor 49 to start supplying the sheet P, and the ID drive unit 45 drives the drum motor 48. In step S5, the process waits until the sheet P reaches the inlet sensor 36 to turn on the inlet sensor 36. When the sheet P reaches the inlet sensor 36 to turn on the inlet sensor 36, the process proceeds to step S6.

In step S6, the transfer voltage is determined. In step S7, the process waits until the sheet P reaches the writing sensor 37 to turn on the writing sensor 37. When the sheet P reaches the writing sensor 37 to turn on the writing sensor 37, the process proceeds to step S8. In step S8, the process waits for a timing of the transfer process. When it becomes the timing of the transfer process, the process proceeds to step S9.

In step S9, the transfer process is sequentially performed, and the flag is turned on. In step S10, the process waits until the inlet sensor 36 is turned off. When the inlet sensor 36 is turned off, the process is complete.

Figure 7:
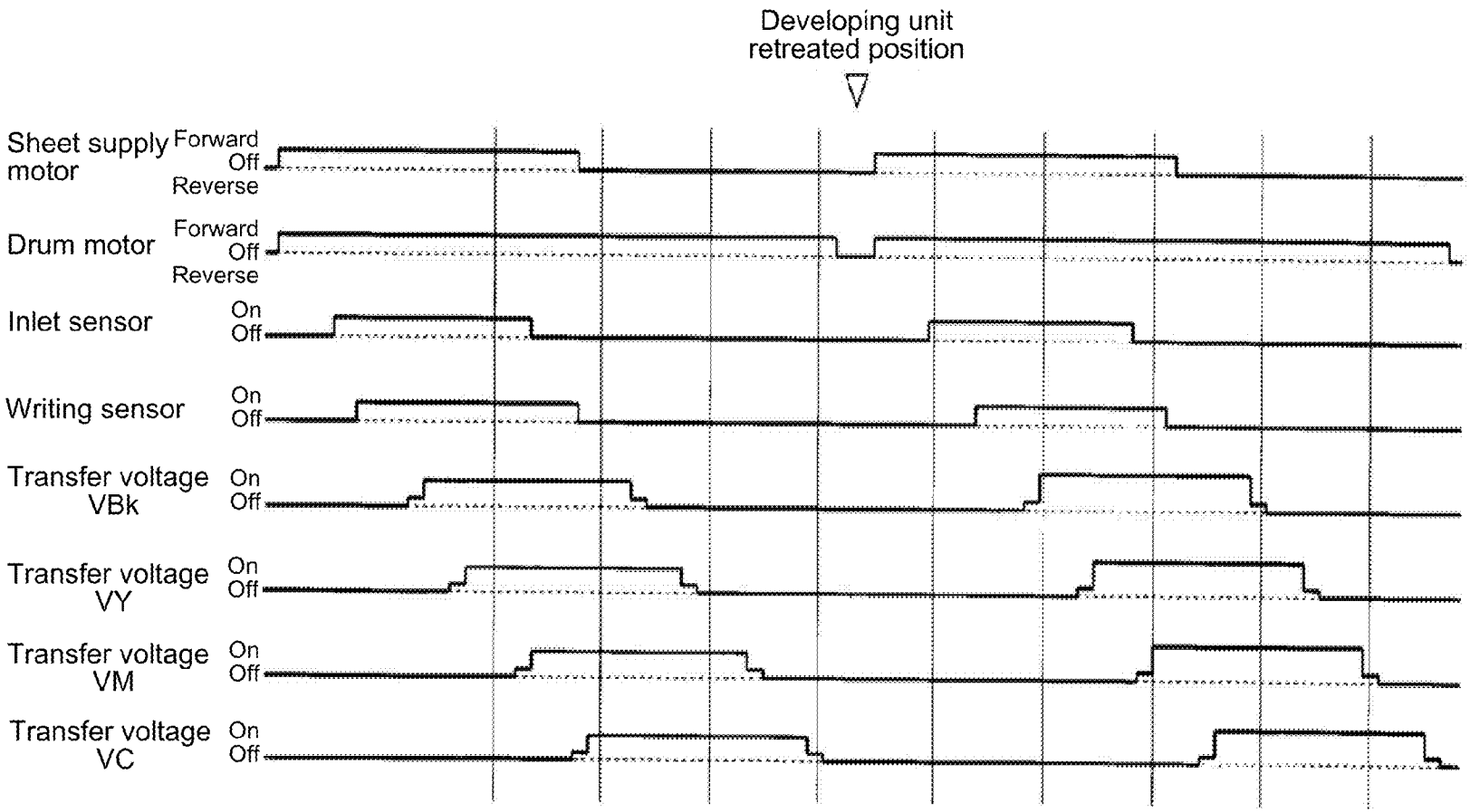
FIG. 7 is a time chart showing a printing operation of the color printer according to the first embodiment of the present invention.

The printing operation of the color printer will be explained next. FIG. 7 is a time chart showing the printing operation of the color printer according to the first embodiment of the present invention. In FIG. 7, "forward" represents a forward rotation of the drum motor 48 or the sheet supply motor 49, and "reverse" represents a reverse rotation of the drum motor 48 or the sheet supply motor 49.

In the following description, it is supposed that the color printer intermittently prints on three sheets P. The first sheet P and the third sheet P are printed in color, and the second sheet P is printed in monochrome.

First, when the sheet supply motor 49 is driven to rotate the pickup roller 32 for supplying the sheet P, the drum motor 48 is driven at the same time to rotate the photosensitive drums 11. When the sheet P reaches the inlet sensor 36, the inlet sensor 36 is turned on, and when the sheet P reaches the writing sensor 37, the writing sensor 37 is turned on.

In the next step, the transfer voltages VBk, VY, VM, and VC are sequentially applied to the transfer rollers 22 with a specific interval at a specific transfer timing after a specific period of time after the writing sensor 37 is turned on.

In the embodiment, the transfer voltages VBk, VY, VM, and VC tend to take time to increase from 0 V. Accordingly, it is arranged such that the transfer voltages VBk, VY, VM, and VC increase slightly before the timing when the transfer voltages VBk, VY, VM, and VC are applied.

After the inlet sensor 36 detects a trailing edge of the sheet P and the inlet sensor 36 is turned off, when a specific period of time is elapsed after the inlet sensor 36 is turned off, the sheet supply motor 49 is turned off. Further, after the writing sensor 37 detects the trailing edge of the sheet P and the writing sensor 37 is turned off, when a specific period of time is elapsed after the writing sensor 37 is turned off, the transfer voltages VBk, VY, VM, and VC sequentially decrease and become zero.

As described above, it is supposed that the color printer intermittently prints on the three sheets P. Accordingly, after the first sheet P is printed as explained above, the drum motor 48 stops.

In the next step, the printing operation starts for printing the second sheet P. As described above, it is supposed that the color printer intermittently prints on the three sheets P, and the second sheet P is printed in monochrome. Accordingly, the developing units move the retreated position. In this case, it is arranged to set the transfer voltage VBk the same as that in the continuous printing operation. Further, it is arranged to set the transfer voltages VY, VM, and VC greater than those in the color printing operation.

As described above, in the embodiment, only when the single color printing operation is performed without performing the continuous printing operation, the developing units move the retreated position. When the continuous printing operation or the color printing operation is performed, the developing units move the operational position. Accordingly, when the color printing operation is switched to the single color printing operation, or the single color printing operation is switched to the color printing operation, it is possible to switch the developing unit between the operational position and the retreated position for a fewer times, thereby improving print through put.

Further, in the embodiment, it is not necessary to move the image forming units Y, M, and C. Instead, it is necessary to simply move the developing units to the operational position or the retreated position. Accordingly, it is possible to make a mechanism simple.

Further, in the embodiment, when the single color printing operation is performed without performing the continuous printing operation, it is arranged to set the transfer voltages VY, VM, and VC greater than those in the color printing operation. As a result, it is possible to return the opposite charged toner adhering to the sheet P back to the photosensitive drums 11, thereby preventing the fog. Further, it is possible to prevent the reverse transfer, thereby improving image quality.

In the embodiment, when the single color printing operation is performed, the toner image in black is transferred to the sheet P as the medium. Alternatively, the toner image in black may be transferred to an intermediate transfer medium as the medium.

Second Embodiment

A second embodiment of the present invention will be explained next. Components in the second embodiment similar to those in the first embodiment are designated with the same reference numerals, and provide effects similar to those in the first embodiment.

In the first embodiment, it is arranged such that the developing voltage with a polarity the same as that of toner charged with the developing blades 17 is applied to the developing rollers 16. Accordingly, it is possible to efficiently attach toner to the static latent images.

In this case, when the developing voltage is greater than the charge voltage for charging the surfaces of the photosensitive drums 11 with the charge rollers 12, toner tends to adhere to an area other than the static latent images. Accordingly, the developing voltage is set within a range of a half to two thirds of the charge voltage, thereby preventing toner from adhering to an area other than the static latent images.

However, a slight amount of toner not charged with the developing blades 17 tends to move from the developing rollers 16 to the photosensitive drums 11 having a higher potential. A slight amount of toner on the photosensitive drums 11 may adhere to the sheet P through van der Waals attraction, thereby causing the fog and lowering image quality.

To this end, in the second embodiment, when the single color printing operation is performed while the developing units are situated at the operational position, a specific developing voltage is applied to the developing rollers 16 of the image forming units Y, M, and C. The specific developing voltage has an absolute value greater than that of the developing voltage applied to the developing roller 16 of the image forming unit Bk, in which the toner image in black is formed. Accordingly, it is possible to prevent toner from moving to the surfaces of the photosensitive drums 11 from the developing rollers 16.

Figure 8:
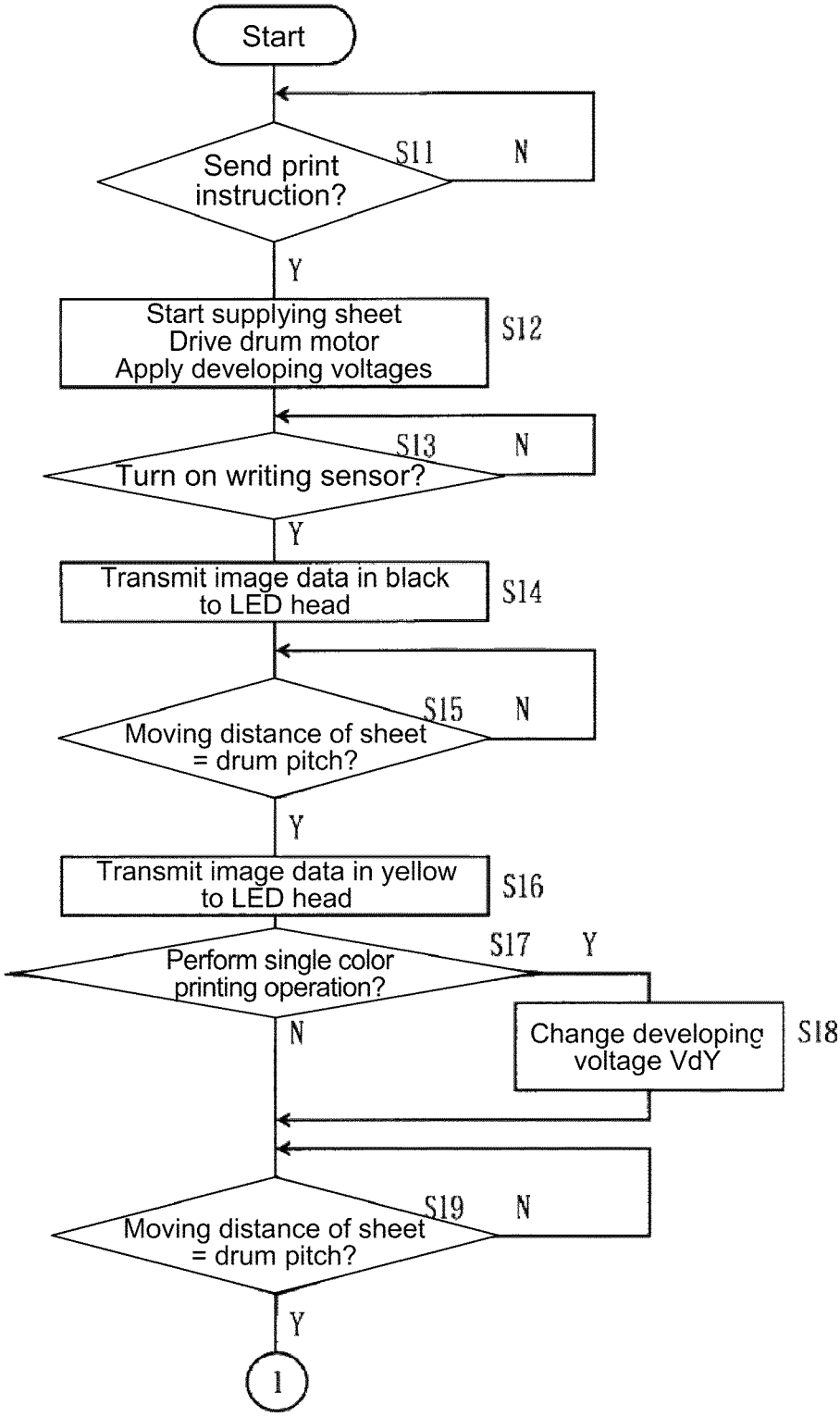
FIG. 8 is a flow chart No. 1 showing an operation of a color printer according to a second embodiment of the present invention.
Figure 9:
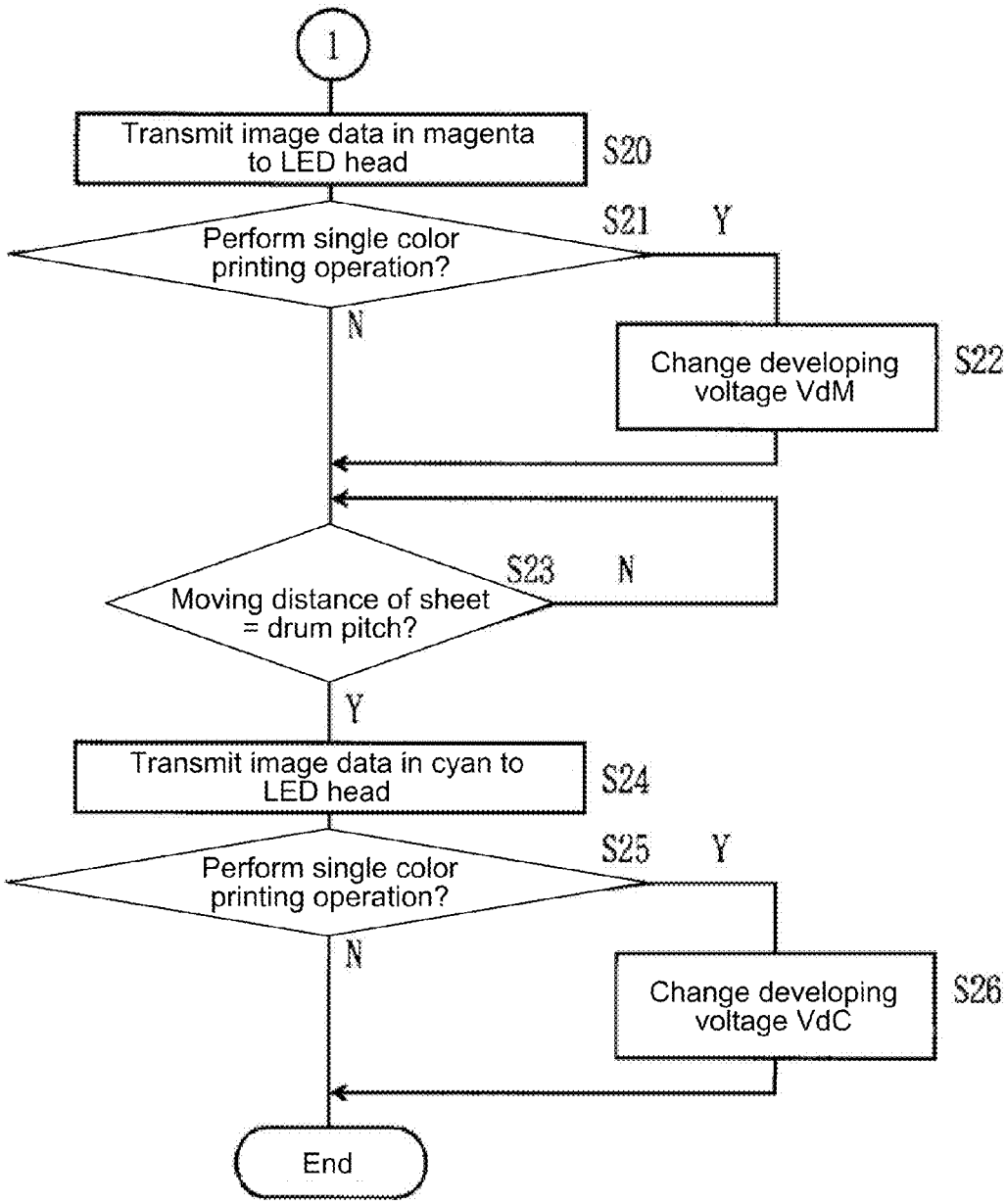
FIG. 9 is a flow chart No. 2 showing the operation of the color printer according to the second embodiment of the present invention.

FIG. 8 is a flow chart No. 1 showing an operation of a color printer according to the second embodiment of the present invention. FIG. 9 is a flow chart No. 2 showing the operation of the color printer according to the second embodiment of the present invention.

First, the CPU 41 waits for the print instruction from the host computer. In this state, the fixing device 35 as the fixing unit is maintained at a specific temperature, so that it is possible to immediately start the printing operation once the print instruction is transmitted. Note that the fixing device 35 is maintained at the specific temperature lower than the normal fixing temperature at which the printing operation is actually performed. When the printing operation starts, the fixing device 35 is heated up to the normal fixing temperature at a timing that the sheet P reaches the fixing device 35.

In the next step, when the host computer transmits the print instruction, the sheet supply transportation fixing drive unit 46 drives the sheet supply motor 49 as the third drive unit to start supplying the sheet P. Further, the ID drive unit 45 drives the drum motor 48 to start rotating the photosensitive drums 11 as the image supporting members and the likes, and the belt drive unit 44 drives the belt motor 47 to start moving the transfer belt 21.

In the embodiment, the photosensitive drums 11 are connected to the developing rollers 16 as the developer supporting members through a gear (not shown). Accordingly, when the photosensitive drums 11 start rotating, the developing rollers 16 start rotating as well.

In the embodiment, a developing processing unit (not shown) of the CPU 41 as a voltage application processing unit (not shown) performs a developing process as a voltage application process. In the voltage application process, the developing processing unit (not shown) of the CPU 41 retrieves a temperature and humidity from the environmental sensor 39. With reference to the table shown in FIG. 6, the developing voltage generation units 52Bk, 52Y, 52M, and 52C generate developing voltages VdBk, VdY, VdM, and VdC for the color printing operation. Then, the developing voltages VdBk, VdY, VdM, and VdC are applied to the developing rollers 16.

When the sheet P reaches the writing sensor 37 to turn on the writing sensor 37, the image control unit 43 starts transmitting the image data in black to the LED head 23 as the exposure device of the image forming unit Bk at a specific timing after a specific period of time. Accordingly, the LED head 23 is driven and forms the static latent image on the surface of the photosensitive drum 11 of the image forming unit Bk.

In the embodiment, the belt motor 47 is a stepping motor. Accordingly, it is arranged to monitor a moving distance of the sheet P according to a pulse number of the belt motor 47. When the moving distance of the sheet P becomes a drum pitch (a distance between each of the photosensitive drums 11), the image control unit 43 transmits the image data in yellow to the LED head 23 of the image forming unit Y. Accordingly, the LED head 23 is driven and forms the static latent image on the surface of the photosensitive drum 11 of the image forming unit Y.

When the color printing operation is performed, the image control unit 43 transmits the image data in yellow, magenta, and cyan to the LED heads 23 of the image forming units Y, M, and C, respectively. When the single color printing operation is performed, the image control unit 43 does not transmit the image data in yellow, magenta, and cyan to the LED heads 23 of the image forming units Y, M, and C.

In the next step, the print instruction determination processing unit (not shown) of the CPU 41 determines whether the print instruction instructs the single color printing operation. When it is determined that the print instruction instructs the single color printing operation, the developing process unit refers to the table, and changes the developing voltage VdY for the color printing operation to the developing voltage VdY for the single color printing operation.

When the moving distance of the sheet P becomes the drum pitch, the image control unit 43 transmits the image data in magenta to the LED head 23 of the image forming unit M. Accordingly, the LED head 23 is driven and forms the static latent image on the surface of the photosensitive drum 11 of the image forming unit M.

In the next step, the print instruction determination processing unit (not shown) of the CPU 41 determines whether the print instruction instructs the single color printing operation. When it is determined that the print instruction instructs the single color printing operation, the developing process unit refers to the table, and changes the developing voltage VdM for the color printing operation to the developing voltage VdM for the single color printing operation.

When the moving distance of the sheet P becomes the drum pitch, the image control unit 43 transmits the image data in cyan to the LED head 23 of the image forming unit C. Accordingly, the LED head 23 is driven and forms the static latent image on the surface of the photosensitive drum 11 of the image forming unit C.

In the next step, the print instruction determination processing unit (not shown) of the CPU 41 determines whether the print instruction instructs the single color printing operation. When it is determined that the print instruction instructs the single color printing operation, the developing process unit refers to the table, and changes the developing voltage VdC for the color printing operation to the developing voltage VdC for the single color printing operation.

After the developing process is performed in each of the developing units, the developing processing unit turns on a flag during the developing process, so that the flag can be referred during other processing routines.

The flow charts shown in FIGS. 8 and 9 will be explained next. In step S11, the CPU 41 waits for the print instruction from the host computer. When the host computer sends the print instruction, the process proceeds to step S12. In step S12, the sheet supply transportation fixing drive unit 46 drives the sheet supply motor 49 to start supplying the sheet P. Further, the ID drive unit 45 drives the drum motor 48 to start rotating the photosensitive drums 11. Then, the developing voltages VdBk, VdY, VdM, and VdC for the color printing operation are applied to the developing rollers 16.

In step S13, the process waits until the sheet P reaches the writing sensor 37 to turn on the writing sensor 37. When the sheet P reaches the writing sensor 37 to turn on the writing sensor 37, the process proceeds to step S14. In step S14, the image control unit 43 starts transmitting the image data in black to the LED head 23 of the image forming unit Bk. In step S15, the process waits until the moving distance of the sheet P becomes the drum pitch. When the moving distance of the sheet P becomes the drum pitch, the process proceeds to step S16. In step S16, the image control unit 43 starts transmitting the image data in yellow to the LED head 23 of the image forming unit Y.

In step S17, it is determined whether the single color printing operation is performed. When it is determined that the single color printing operation is performed, the process proceeds to step S18. When it is determined that the single color printing operation is not performed, the process proceeds to step S19.

In step S18, the developing process unit changes the developing voltage VdY for the color printing operation to the developing voltage VdY for the single color printing operation. In step S19, the process waits until the moving distance of the sheet P becomes the drum pitch. When the moving distance of the sheet P becomes the drum pitch, the process proceeds to step S20. In step S20, the image control unit 43 starts transmitting the image data in magenta to the LED head 23 of the image forming unit M.

In step S21, it is determined whether the single color printing operation is performed. When it is determined that the single color printing operation is performed, the process proceeds to step S22. When it is determined that the single color printing operation is not performed, the process proceeds to step S23.

In step S22, the developing process unit changes the developing voltage VdM for the color printing operation to the developing voltage VdM for the single color printing operation. In step S23, the process waits until the moving distance of the sheet P becomes the drum pitch. When the moving distance of the sheet P becomes the drum pitch, the process proceeds to step S24. In step S24, the image control unit 43 starts transmitting the image data in cyan to the LED head 23 of the image forming unit C.

In step S25, it is determined whether the single color printing operation is performed. When it is determined that the single color printing operation is performed, the process proceeds to step S26. When it is determined that the single color printing operation is not performed, the process is complete. In step S26, the developing process unit changes the developing voltage VdC for the color printing operation to the developing voltage VdC for the single color printing operation, thereby completing the process.

Figure 10:
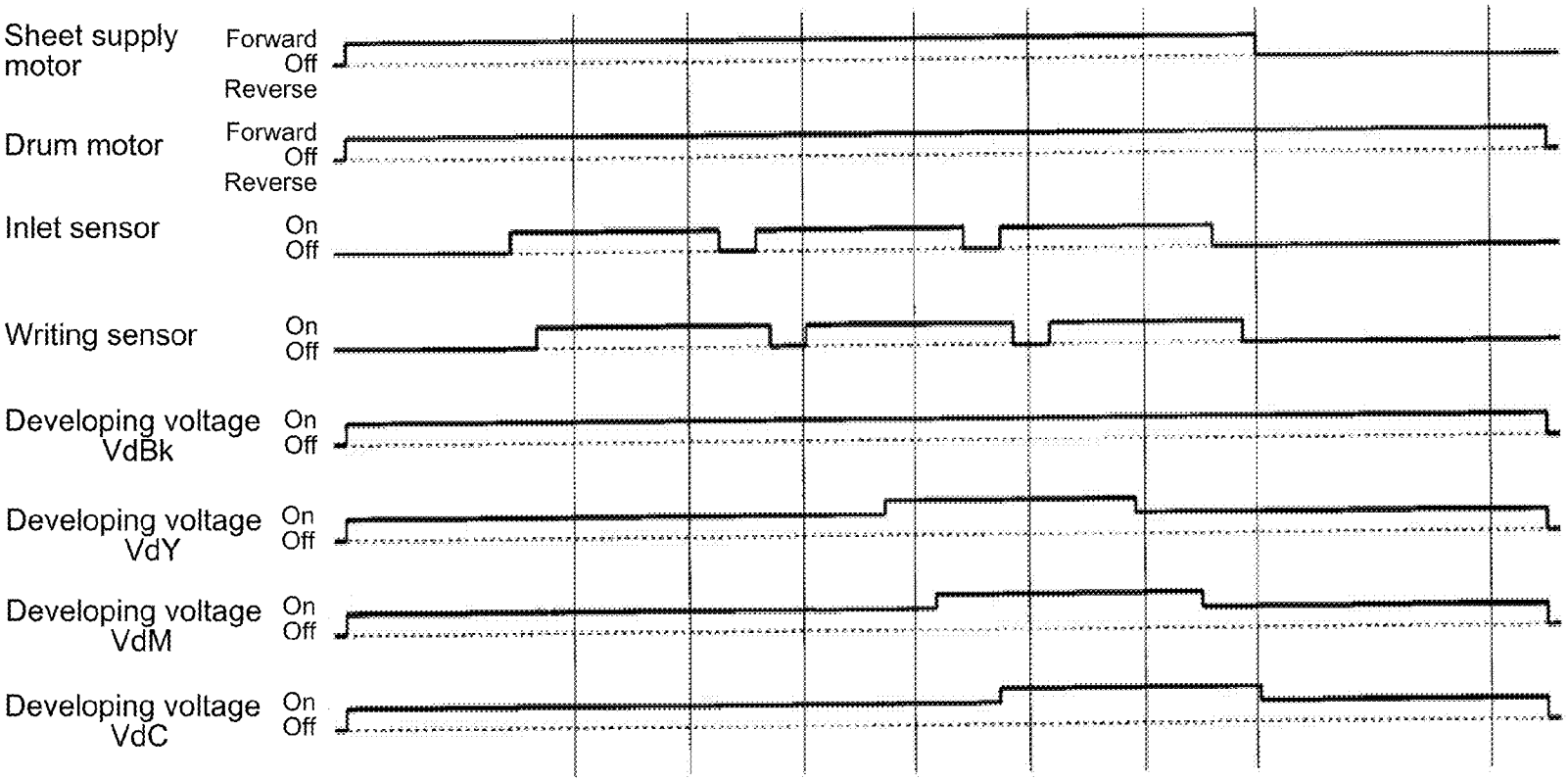
FIG. 10 is a time chart showing a printing operation of the color printer according to the second embodiment of the present invention.

The printing operation of the color printer will be explained next. FIG. 10 is a time chart showing the printing operation of the color printer according to the second embodiment of the present invention. In the following description, it is supposed that the color printer continuously prints on three sheets P. The first sheet P and the third sheet P are printed in color, and the second sheet P is printed in monochrome.

First, when the sheet supply motor 49 is driven to rotate the pickup roller 32 for supplying the sheet P, the drum motor 48 is driven at the same time to rotate the photosensitive drums 11. When the sheet P reaches the inlet sensor 36, the inlet sensor 36 is turned on, and when the sheet P reaches the writing sensor 37, the writing sensor 37 is turned on.

In the next step, the developing voltages VdY, VdM, and VdC for the color printing operation are sequentially changed to the developing voltages VdY, VdM, and VdC for the single color printing operation at a specific timing after a specific period of time after the writing sensor 37 is turned on.

As described above, in the embodiment, the developing voltages VdY, VdM, and VdC for the color printing operation are applied to the developing rollers in advance. Accordingly, when the single color printing operation is performed, the higher developing voltage is applied to the image forming units Y, M, and C that are not performing the printing operation. As a result, it is possible to prevent the fog.

In the embodiments described above, the color printer is explained as the image forming apparatus. The present invention is applicable to a copier, a facsimile, a multi-function product, and the likes.

The disclosure of Japanese Patent Application No. 2008-254080, filed on Sep. 30, 2008, is incorporated in the application by reference.

While the invention has been explained with reference to the specific embodiments of the invention, the explanation is illustrative and the invention is limited only by the appended claims.

What is claimed is:

1. An image forming apparatus comprising:

a first image supporting member for forming a first static latent image thereon;

a second image supporting member for forming a second static latent image thereon;

a first developer supporting member disposed to abut against the first image supporting member for attaching developer to the first static latent image to form a first developer image in a first color;

a second developer supporting member disposed to abut against the second image supporting member for attaching developer to the second static latent image to form a second developer image in a second color;

a first transfer member disposed to face the first image supporting member for transferring the first developer image on the first image supporting member to a medium;

a second transfer member disposed to face the second image supporting member for transferring the second developer image on the second image supporting member to the medium; and a voltage applying unit for applying a first voltage to one of the first developer supporting member and the first transfer member and a second voltage to one of the second image supporting member and the second transfer member, wherein said voltage applying unit is arranged to apply the second voltage greater than the first voltage to one of the second developer supporting member and the second transfer member when a printing operation is performed to form a first image on a medium in the first color and not to form a second image on the medium in the second color.

2. The image forming apparatus according to claim 1, wherein said voltage applying unit is arranged to apply the second voltage as a transfer voltage greater than the first voltage to the second transfer member when the printing operation is performed to form the first image in the first color and not to form the second image in the second color.

3. The image forming apparatus according to claim 1, wherein said voltage applying unit is arranged to apply the second voltage as a developing voltage greater than the first voltage to the second developer supporting member when the printing operation is performed to form the first image in the first color and not to form the second image in the second color.

4. The image forming apparatus according to claim 1, further comprising a print instruction determination processing unit for determining whether a print instruction instructs that the printing operation is performed to form the first image in the first color and not to form the second image in the second color, and the printing operation is not performed continuously.

5. The image forming apparatus according to claim 4, further comprising a separation processing unit for moving the second developer supporting member away from the second image supporting member when the print instruction determination processing unit determines that the print instruction instructs that the printing operation is performed to form the first image in the first color and not to form the second image in the second color, and the printing operation is not performed continuously.

6. The image forming apparatus according to claim 1, wherein said first image supporting member is disposed on an upstream side in a direction that the medium is transported with respect to the second image supporting member.

7. The image forming apparatus according to claim 1, wherein said first developer supporting member is disposed on an upstream side in a direction that the medium is transported with respect to the second developer supporting member.

8. The image forming apparatus according to claim 1, wherein said first transfer member is disposed on an upstream side in a direction that the medium is transported with respect to the second transfer member.

9. The image forming apparatus according to claim 1, wherein said voltage applying unit is arranged to increase at least one of the first voltage and the second voltage when at least one of an environmental temperature and an environmental humidity decreases.

10. The image forming apparatus according to claim 1, wherein said voltage applying unit is arranged to decrease at least one of the first voltage and the second voltage when at least one of an environmental temperature and an environmental humidity increases.

* * * * *